US007375269B2

(12) United States Patent
Perkins

(10) Patent No.: US 7,375,269 B2
(45) Date of Patent: May 20, 2008

(54) BASS GUITAR STAND UP ADAPTER

(76) Inventor: Michael T. Perkins, 902 McPimal St., Austin, TX (US) 78758

( * ) Notice: Subject to any disclaimer, the term of this patent is extended or adjusted under 35 U.S.C. 154(b) by 131 days.

(21) Appl. No.: 11/333,396

(22) Filed: Jan. 17, 2006

(65) Prior Publication Data

US 2006/0156896 A1 Jul. 20, 2006

(51) Int. Cl.
*G10D 3/00* (2006.01)
*A45C 13/30* (2006.01)

(52) U.S. Cl. ..... 84/327; 84/327; 224/910; 248/443; 248/121

(58) Field of Classification Search ..... 224/910; 84/327; 248/121, 443
See application file for complete search history.

(56) References Cited

U.S. PATENT DOCUMENTS 1,464,279 A * 8/1923 Hindley ..... 248/125.1
1,541,767 A * 6/1925 Mortensen ..... 248/125.8
3,102,446 A * 9/1963 Raleigh ..... 84/327
3,833,751 A * 9/1974 Chapman ..... 84/726
4,037,815 A * 7/1977 DeLano ..... 248/542
RE31,722 E * 11/1984 Steinberger ..... 84/327
4,632,002 A * 12/1986 Clevinger ..... 84/731
4,646,613 A * 3/1987 Banchetti ..... 84/327
4,693,161 A 9/1987 Uhrig
4,715,259 A * 12/1987 Wittman ..... 84/327
4,742,751 A * 5/1988 Cherry ..... 84/327
5,000,071 A * 3/1991 Thomas ..... 84/327
5,069,103 A * 12/1991 Healy ..... 84/327
5,202,527 A * 4/1993 Gracie ..... 84/327
5,332,137 A * 7/1994 Violette ..... 224/257
5,537,906 A * 7/1996 Steinberger ..... 84/291
5,664,758 A * 9/1997 Smith ..... 248/688
5,824,924 A * 10/1998 Agostino ..... 84/291
5,903,995 A * 5/1999 Brubach ..... 42/94
6,027,087 A * 2/2000 Lindemann et al. ..... 248/188.5
6,034,308 A 3/2000 Little
6,084,165 A * 7/2000 Chapman ..... 84/291
6,359,203 B1 * 3/2002 Cronos ..... 84/327
6,422,522 B1 7/2002 Woollen
6,525,246 B1 2/2003 Erismann
6,540,182 B1 4/2003 Wilfer (Continued)

OTHER PUBLICATIONS

Conklin Guitar & Basses, catalog and history of Conklin products, Copyright 1998, available at www.conklinguitars.com.*

(Continued)

*Primary Examiner*—Lincoln Donovan
*Assistant Examiner*—Robert W Horn
(74) *Attorney, Agent, or Firm*—Michael T. Perkins

(57) ABSTRACT

An apparatus for converting a standard electric bass guitar to play as a classical upright bass guitar. A bass guitar stand up apparatus may include a mounting stand such as a tri or uni-pod, an adapter, an arm, and a stabilizer. The apparatus may be adjustable for height selection. The apparatus may be quick release for convenience. The arm may facilitate positioning. The stabilizer may mount to lower strap mount. The apparatus may be easily removed and guitar may be played, docked, or transported in standard guitar configuration. The apparatus can also be configured to a supportive belt to afford mobility to a musician while supporting and playing a standard electric bass guitar.

28 Claims, 10 Drawing Sheets

U.S. PATENT DOCUMENTS

| | | | | |
|---|---|---|---|---|
| 6,576,822 | B1 | 6/2003 | Grace | |
| 6,683,237 | B2 | 1/2004 | Christou | |
| 6,693,234 | B2 * | 2/2004 | Smith | 84/327 |
| 6,747,197 | B2 | 6/2004 | Kellogg | |
| 6,774,291 | B2 | 8/2004 | Vartiainen | |
| 6,888,055 | B2 | 5/2005 | Smith et al. | |
| 6,905,264 | B2 * | 6/2005 | McKay | 396/421 |
| 6,943,283 | B2 | 9/2005 | McPherson | |
| 6,977,332 | B2 * | 12/2005 | Liao | 84/421 |
| 6,982,373 | B1 | 1/2006 | Yu | |
| 7,009,097 | B1 * | 3/2006 | Terplivetz | 84/327 |
| 2002/0179785 | A1 * | 12/2002 | Hetrick et al. | 248/146 |
| 2005/0235806 | A1 | 10/2005 | Algerti | |
| 2006/0156896 | A1 * | 7/2006 | Perkins | 84/327 |
| 2006/0213358 | A1 * | 9/2006 | Motsenbocker | 84/731 |

OTHER PUBLICATIONS

Gollihur Music, Upright Bass Specialists, teacing various stands and supports for stand up basses, viewed May 30, 2007, copyrigted, 1997-2007.*

Barker, Joel, Owner's Initiation Guide for the BVB (standup bass and stand), copyright 2003, available at www.barkerbass.com.*

* cited by examiner

BASS GUITAR STAND UP ADAPTER

BACKGROUND

1. Technical Field of Invention

The present invention generally relates to a guitar auxiliary device. In particular, the invention relates to an adapter.

2. Background of the Invention

Traditionally players of bass guitars had to choose between two types of instruments; classical upright acoustic and standard electric (strap type). The upright style is preferable in playing position to most musicians who do not strum the bass as a standard (6 or 12 string non-bass) guitar. The classical type of playing a bass (where the musician plucks and individually manipulates the large strings) requires deftness and strength at the musician's finger tips. An over the shoulder-strap arrangement on a standard electric bass guitar demands the musician, using classical playing techniques, hyper flex his (or her) wrists resulting in compromised playing positions and causing long term tendon problems. Recently custom designed versions of electric bass guitars in an upright configuration have been offered. These include Dean Pace (www.deanguitars.com), and N.S. Design, U.S. Pat. No. 5,537,906 issued to Steinberger. Pace guitars offers an upright electric bass that has a custom body and stand that will not adapt to any standard bass guitar body limiting choices and increasing costs additionally, Pace electric upright bass guitars cannot be played while sitting or mobile. N.S. Design offers a similar custom guitar that will not adapt to any standard bass guitar body limiting choices, increasing costs, and cannot be played while seated. N.S. Design does offer a mobile harness for their electric upright bass however, N.S. Design's mobile harness is uniquely mounted to N.S. Design guitars and not usable with any standard bass guitar additionally, is supported over a player's shoulders increasing load on the player's spine.

Wilfer U.S. Pat. No. 6,588,715 dtd. Jul. 8, 2003, U.S. Pat. No. 6,559,365, and U.S. Pat. No. 6,540,182 discloses a stand for musical instruments. The disclosure of Wilfer allows for docking or parking support of a guitar solely and is not intended to lend support when played. This embodiment will not afford stand up adaptation of a standard electric bass guitar to upright playing. Erismann in U.S. Pat. No. 6,525,246 dtd. Feb. 25, 2003 discloses a detachable body support for a guitar. This embodiment will not afford stand up adaptation of a standard electric bass guitar to upright playing. Little in U.S. Pat. No. 6,034,308 dtd. Mar. 7, 2000 discloses an ergonomic string instrument. While there may be advantages to Little's disclosure this embodiment will not afford stand up adaptation of a standard electric bass guitar to upright playing. Agostino in U.S. Pat. No. 5,824,924 dtd. Oct. 20, 1998 discloses a five postion bow playable, electric bass guitar. While Agostino does offer multiple position playing of a bass guitar his embodiment offers cramped playing (too close to player's body) and non-triangulated support in the upright configuration. This embodiment also requires custom mounting and body configuration causing higher costs and poor transportation characteristics. Additionally, Agostino offers no docking type capabilities. Uhrig in U.S. Pat. No. 4,693,161 dtd. Sep. 15, 1987 discloses an apparatus for supporting a musical instrument. While this apparatus will support a guitar it is not for use while playing. Clevinger in U.S. Pat. No. 4,632,002 dtd. Dec. 30, 1986 discloses a rigidly constructed portable electric double bass. While Clevinger's design is an upright bass that is portable he requires a custom body and traveling case demanding additional costs and no docking or mobile capability.

OBJECT OF INVENTION

Accordingly, it is an object of the present invention to overcome or at least minimize the problems experienced with known instruments and adapter solutions, or to provide a useful alternative to such systems.

A further object of the present invention to allow the musician the pleasure of upright playing of a standard electric bass guitar without the bulk of classical standup bass instruments.

A further object of the present invention is to provide an affordable adapter that will support the demands of performance and traveling.

A further object of the present invention is to provide an adapter that will allow the musician the pleasure of upright playing with the option of frets, for accurate intonation, not commonly available with stand up or double bass instruments.

A further object of the present invention is to provide a convenient and adjustable positioning that can easily be adjusted for the musicians comfort.

A further object of the present invention is to provide a flexible and unobtrusive adapter that can be removed for transporting or guitar strap type playing.

A further object of the present invention is to provide a mobile adapter that will allow a musician to play a standard electric bass guitar in the classical up right position while moving about on stage or otherwise performing.

SUMMARY

A bass guitar stand up adapter may include a support stand, an adapter(s), an arm, a base, a dock support, a stabilizer, and a belt adapter for mobile playing.

DRAWINGS

FIG. 1 is a side view of my bass guitar stand up adapter.

FIG. 2*a* is a view of the back of a bass guitar with bass guitar stand up adapter installed.

FIG. 2*b* is a view of main adapter housing and quick release device.

FIG. 3*a* is a view of main adapter with adapter arm.

FIG. 3*b* is a view of a base adapter.

FIG. 4*a* is a view of a uni-pod vertical adapter.

FIG. 4*b* is rear view of a bass guitar with my stand up adapter.

FIG. 5 is a view of bass guitar stand up adapter with a musician.

FIG. 6*a* is a view of bass guitar stand up adapter parked on a tri-pod stand.

FIG. 6*b* is a view of bass guitar stand up adapter with tri-pod in a seated-playing position.

Figure 1:
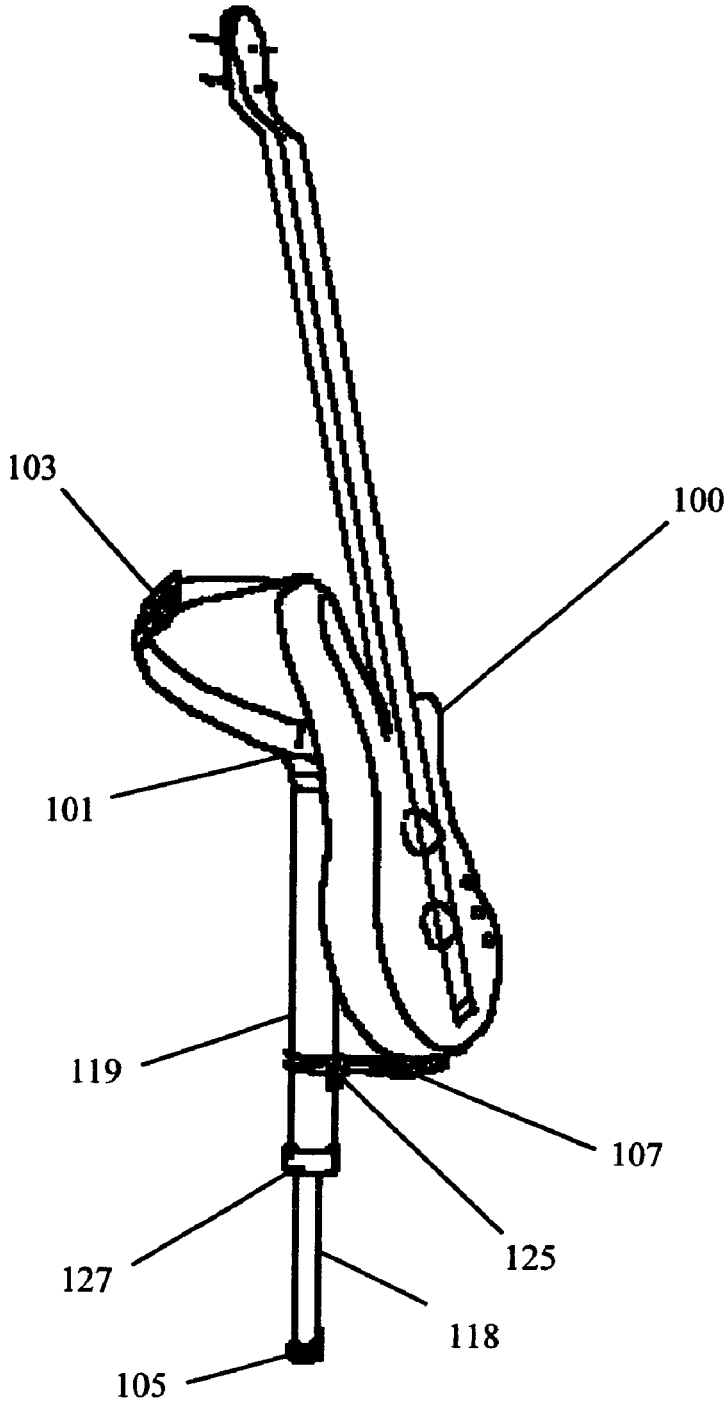

| Reference | Title | Supplier |
|---|---|---|
| 100 | Bass Guitar | Any commercial or custom strap-type standard electric bass guitar |
| 101 | Main upper adapter | Plastic such as ABS |
| 102 | Musician | any |
| 103 | Upper adapter arm | Plastic such as ABS welded or otherwise secured to adapter 101 |
| 105 | Rubber cup | Supplied with unipod 119 |
| 107 | Lower adapter arm | Plastic such as ABS |
| 111 | Foam sheet | 3 mm medium density foam |
| 113 | Mounting hole | 12 mm, 7/16" |
| 115 | Mounting bolt | 12 mm, 7/16" NC grade 3 |
| 117 | Lock washer | 12 mm, 7/16" |
| 118 | Unipod leg | Included in unipod 119 |
| 119 | Unipod | Neopod-6 by Velbon from www.dbldistributing.com |
| 120 | Strap | Carrying strap comes with unipod 119 |
| 123 | Upper strap mount loop | comes with unipod 119 |
| 125 | Lower strap mount loop | comes with unipod 119 |
| 127 | Friction adjusting collars (X3) | comes with unipod 119 |
| 128 | Mounting hole | 12 mm, 7/16" NC comes with unipod 119 |
| 129h | Screw head | Part of strap pin 130 |
| 129t | Screw threads | Part of strap pin 130 |
| 130 | Guitar strap pin | Guitar strap pin; part #5224 from www.stewmac.com |
| 132 | Guitar neck brace plate | Part of guitar 100 |
| 133 | Mounting receiver surface | Plastic part of adapter 101 |
| 134 | Upper attachment strap pin | Existing on guitar 100 |
| 136 | Lower attachment strap pin | Existing on guitar 100 |
| 137 | Central attachment receiver slot | Slot wide enough to create friction when throat of strap pin is inserted |
| 138 | Strap pin button | Part of pin 134 |
| 139 | Upper attachment receiver slot | Configured same as slot 137 |
| 141 | Left Positioning arm locator | Plastic or stainless steel |
| 143 | Right Positioning arm locator | Plastic or stainless steel |
| 145 | Inside Positioning arm locator | Plastic or stainless steel |
| 147 | Adapter saddle | Plastic or stainless steel |
| 149 | Lower attachment receiver slot | Slot wide enough to create friction when throat of strap pin is inserted |
| 150 | Strap pin collar | Part of pin 134 |
| 151 | Strap pin base | Part of pin 134 |
| 153 | Tri-pod stand | Proline MS220CR from www. guitarcenter.com |
| 155 | Main support tube | Part of stand 153 |
| 156 | Stand securing knob | Part of stand 153 |
| 157 | Slot 137 throat | wide enough to create friction when strap pin is inserted |
| 158 | Mobile bass guitar stand up adapter | Mobile version of bass guitar stand up adapter |
| 159 | Slot 137 opening | equal in diameter to a strap pin collar 150 on pin 134 |
| 160 | Musician's playing stool | www.musiciansfriend.com |
| 161 | Supportive belt | U.S. Pat. No. 6,137,675 |
| 163 | Horizontal strap | 3 mm ABS or similar plastic formed by heating or similar material |
| 165 | Upper arm | 3 mm ABS or similar plastic formed by heating |
| 167 | Central slot | Configured same as slot 137 |
| 169 | Lower arm | 3 mm ABS or similar plastic formed by heating |
| 171 | Lower slot | Configured same as slot 137 |
| 173 | Upper slot | Configured same as slot 137 |
| 175 | Support rest | 3 mm ABS or similar plastic |
| 177 | Strut | Plastic 3-5 mm or similar material configured as a rod or box |
| 179 | Strut | Plastic 3-5 mm or similar material configured as a rod or box |

-continued

Reference Numerals in Drawings

| Reference | Title | Supplier |
|---|---|---|
| 181 | Strut | Plastic 3-5 mm or similar material configured as a rod or box |
| 183 | Strut | Plastic 3-5 mm or similar material configured as a rod or box |
| 185 | Front clip | 3 mm ABS or similar plastic |
| 187 | Rear clip | 3 mm ABS or similar plastic |

DETAILED DESCRIPTION OF DRAWINGS

A preferred embodiment in FIG. 1 of my bass guitar stand up adapter shown at a side view discloses a host standard electric bass guitar 100 mounted on a unipod 119. The adapter portion shown in this view includes an adapter upper arm 103 for positioning against the musician's body for stability. The arm 103 is fashioned from such as 3 mm plastic such as ABS. The arm 103 is shown secured to a main upper adapter 101. The arm 103 is shaped in a loop with a concave portion to compliment a chest of a musician and be of the perimeter of a classical upright bass guitar body. The arm 103 can be welded (heat or chemical for ABS) glued or otherwise secured to adapter 101 or made to be removable with such as slots in arm 103 and a receiver in adapter 101 (as a tongue and groove). The adapter 101 is also fashioned from such as 3 mm plastic. A lower strap mount loop 125 is used to locate and secure a lower adapter arm 107 between guitar 100 to unipod 119. A friction adjusting collar(s) 127 on unipod 119 can be used to adjust a unipod leg 118 length and musicians playing height. Unipod 119 rests on a rubber cup 105 (supplied with unipod 119) to prevent damage to leg 118 and supporting surface.

Figure 2A:
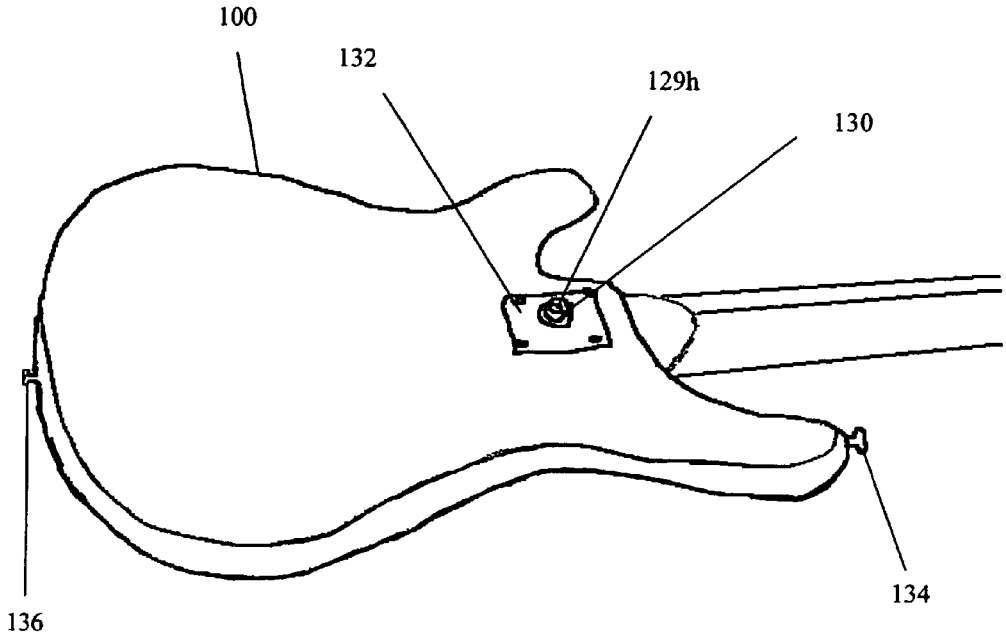

A preferred embodiment of FIG. 2*a* the mounting of my bass stand up adapter is shown from the back of guitar 100. An arm mounting plate 132 (existing on most bass guitars) is shown. A central guitar body attachment strap pin 130 is shown screwed to plate 132 with screw 129 that is supplied with pin 130. If no plate 132 is available the screw 129 can be secured directly to guitar 100 body in a similar configuration. An upper guitar body attachment strap pin 134 is shown. Pin 134 is typically supplied on most electric base guitars. A lower guitar body attachment strap pin 136 is shown. Pin 136 is typically supplied on most electric base guitars. The 3 pins (130, 134, and 136 are arranged to triangulate the stress forces when supporting and positioning a guitar 101 in the stand up playing position. Where no facility for mounting by strap pins on a guitar body is provided, standard strap pins can be configured and secured in an arrangement as shown to provide triangulation of mounting and playing forces and provide musician with a stable platform.

Figure 2B:
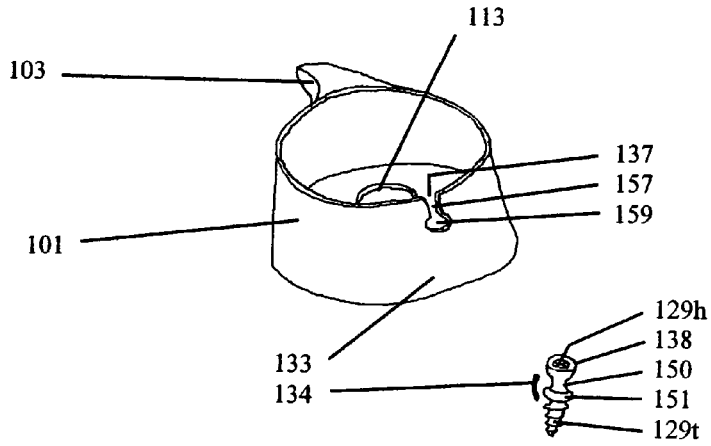
Figure 4A:
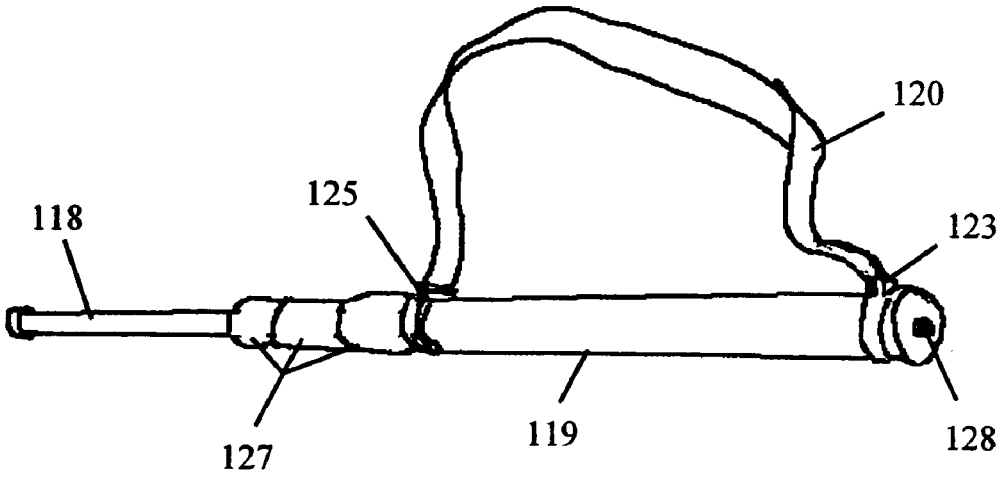

A preferred embodiment of the adapter 101 is shown in FIG. 2*b*. Adapter 101 is fashioned from a strip of material that is heated to form the conical shape disclosed with a slight taper toward the top. The bottom of adapter 101 has another piece of material welded or glued to the bottom. A portion of arm 103 is shown where it is welded or glued to adapter 101. The adapter 101 bottom has a mounting hole 113 to correspond to the unipod 119 threaded hole (FIG. 4*a*). Returning to FIG. 2*b*, adapter 101 has an attachment receiver slot 137 on mounting receiver surface 133. Slot 137 has a throat 157 that is wide enough to create friction when pin 130 is inserted. Slot 137 has an opening 159 at an end that is equal in diameter to a strap pin collar 150 on pin 134, allowing pin 130 to rest in opening 159. Slot 137 will require force to insert or remove pin 130. Slot 137 will hold pin 130 in opening after being inserted through throat 157. The details of a typical pin 130,134, or 136 (same basic pin) are also shown. Pin 134 shows a screw head 129*h*, a strap pin button 138, strap pin collar 150, a strap pin base 151 and a set of screw threads 129*t*.

Figure 3A:
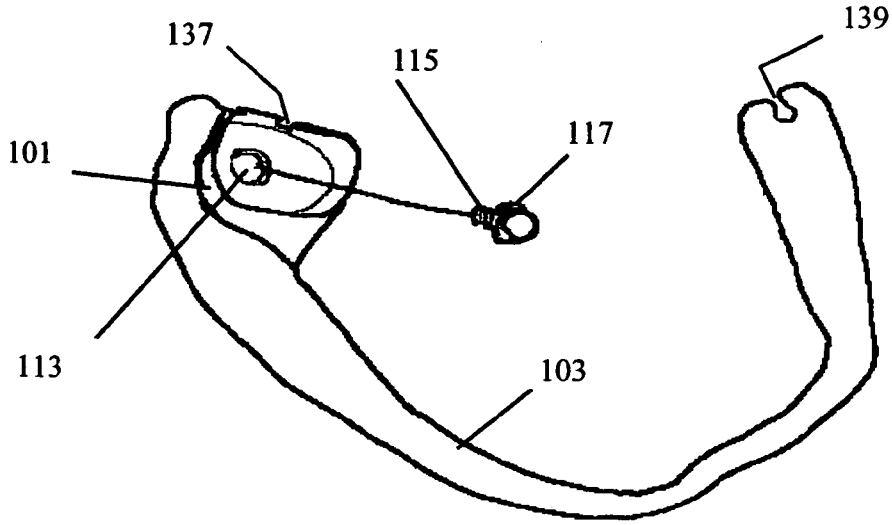

A detailed view of arm 103 from the top view is shown in FIG. 3*a*. An attachment receiver slot 139 is shown for connection to pin 134 on guitar 100 (FIG. 2*a*). Slot 139 has the same throat 157 and opening 159 as slot 137 (for use with pin 134) on FIG. 2*b*. Returning to FIG. 3*a*, hole 113 is shown for mounting adapter 101 to unipod 119 (FIG. 1). Returning to FIG. 3*a*, slot 137 is identified for perspective purposes. A mounting bolt 115 is provided with a direction line to hole 113 for mounting to unipod 119 through hole 113. A lock washer 117 is also shown for securing adapter 101 to unipod 119. The curvilinear shape of arm 103 has the function of locating the musician's body next to guitar 101 various shapes may improve playability for different musicians. Arm 103 can be made adjustable with a sliding belt collar or similar adjustable securing devices.

Figure 3B:
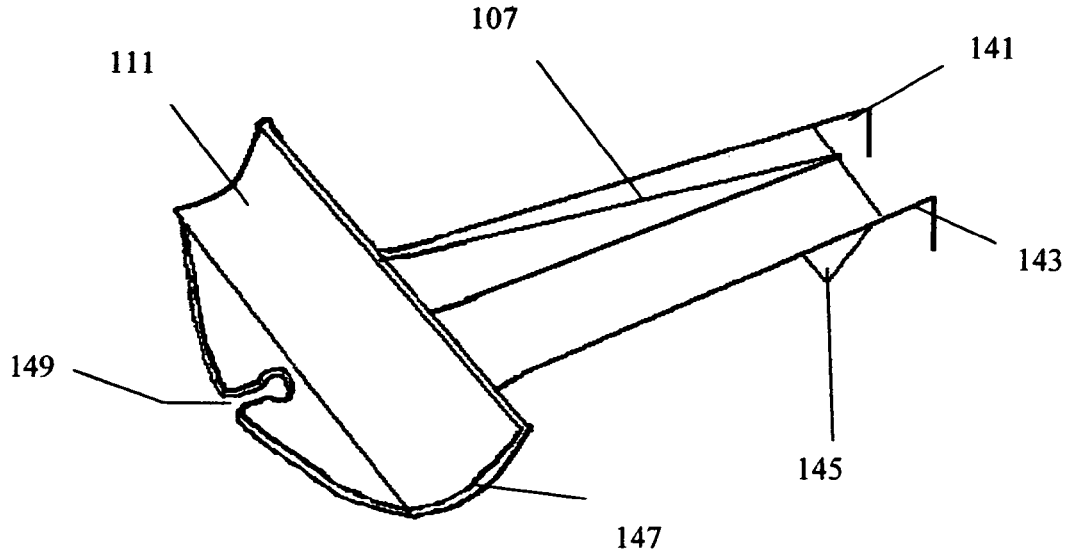

A detailed view of arm 107 is shown in FIG. 3*b*. A left positioning arm locator 141 and a right positioning arm locator 143 are shown for grasping unipod 119 at loop 125 (FIG. 4*a*). Also shown in FIG. 3*b* is a locator 145 for further stabilizing arm 107. A saddle 147 is shown, providing a complimentary surface to base of guitar 100. An attachment receiver slot 149 is provided for locating adapter 107 to pin 136 (FIG. 2*a*). Slot 139 has the same throat 157 and opening 159 as slot 137 (for mounting pin 136) on FIG. 2*b*. The arm 107 is fashioned from plastic such as 3 mm ABS surrounding metal re-enforcement such as 3 mm stainless steel rod bent to form locators 141 and 143. The saddle 147 has a liner of 3 mm foam 111 to cushion guitar 100. Arm 107 can be made of various lengths to increase or decrease the playing angle of mounted guitar. Locators 141 and 143 can be bent around loop 125 to allow arm 107 to rotate up and out of the way when transporting apparatus.

A detailed view of unipod 119 is shown in FIG. 4*a*. The unipod has a threaded mounting hole 128 (12 mm, 7/16" NC) for mounting of adapter 101. The unipod also has an upper strap mounting loop 123 for mounting of carrying strap 120. Strap 120 may be retained for transporting or removed as strap 120 has no function in the positioning and support of guitar. Loop 125 secures strap 120 and also provides a mounting site for arm 107 and locators 141, 143, and 145. A series (3) of friction adjusting collar(s) 127 are shown, these are provided for length adjustment of leg 118 and when configured; playing height of unipod 119.

Figure 4B:
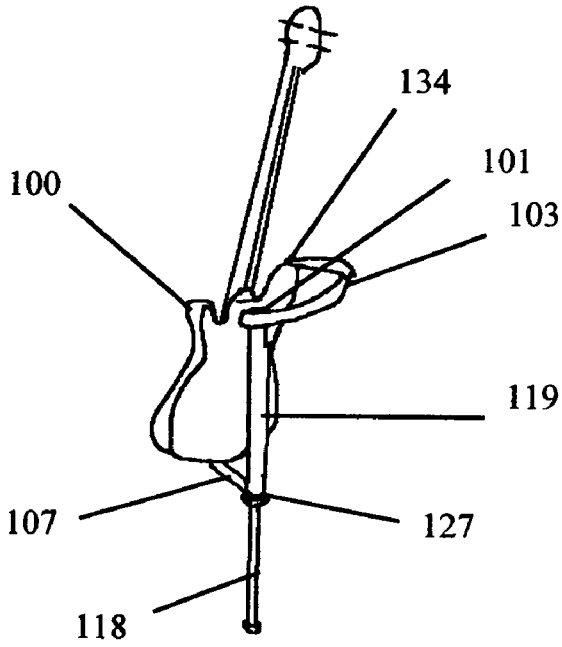

A rear view of my bass guitar stand up adapter is shown in FIG. 4*b*. The guitar 100 is shown with arm 107 mounted and arm 103 connecting to pin 134. The shape of arm 103 stabilizes adapter 101 and provides a position locator for the musician that is part of a classical upright bass. The unipod 119 is assembled to adapter 101 and arm 107 completing triangulation of the mounting for upright positioning. The collar(s) 127 is shown for operation and height adjustment of leg 118.

Figure 5:
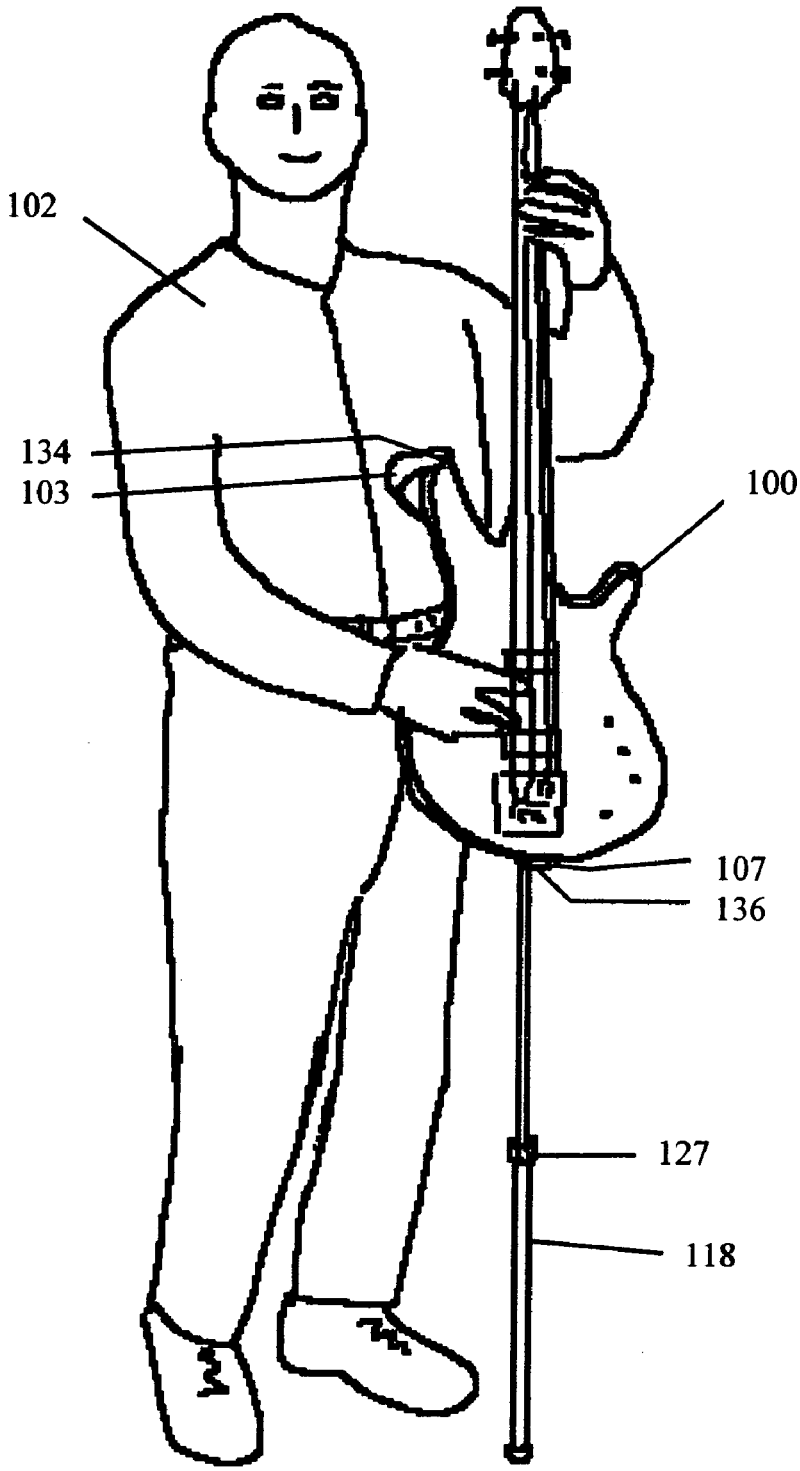

A view of my bass guitar stand up adapter with a guitar 100 and a musician 102 are shown in FIG. 5. The arm 103 is shown secured by pin 134 and positioned against musician 102 for stability. Arm 107 is shown secured to pin 136. Collar(s) 127 is shown extended for height adjustment. This combination of unipod 119 (with collar(s) 127) and adapters (103, and 107) allows the player to also readjust height for a seated position in a chair or on a stool, further increasing flexibility and utility.

Figure 6A:
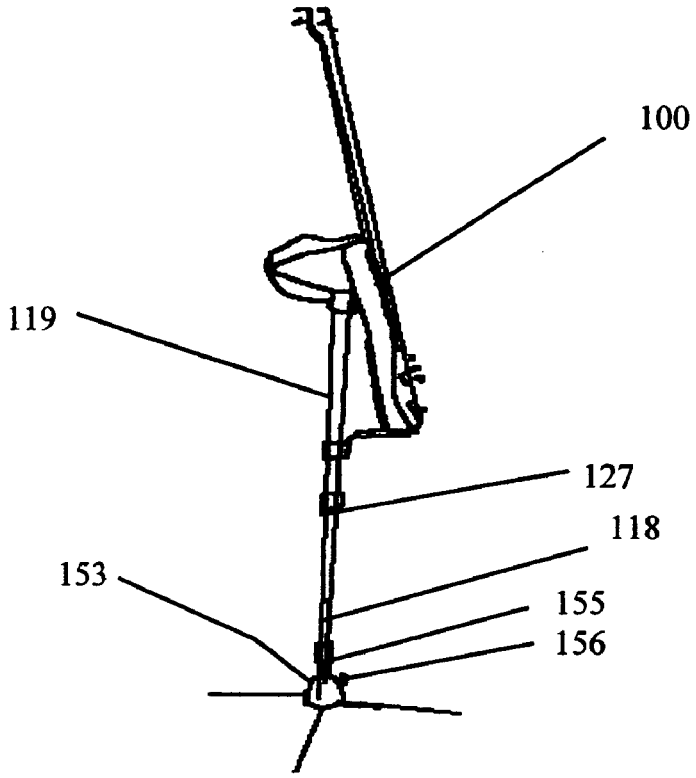

A view of guitar 100 and my bass guitar stand up adapter with unipod 119 inserted into a modified tri-pod stand 153 is shown in FIG. 6*a*. Prior to inserting leg 118 into stand 153 cup 105 must be removed from leg 118 (shown in FIG. 1). Returning to FIG. 6*a*, stand 153 is modified by cutting a main tube 155 of stand 153 to 20 mm in length. With the tube 155 adjusted and secured by securing knob 156 as shown (about 5 mm of tube 155) above stand 153 and sufficient length extends below stand 153 body towards floor, but not touching supporting surface) and leg 118 is inserted into stand 153 leg 118 is secured. A musician can park guitar 100 when not in use. The stand 153 can also be used as a brace when playing standing or seated (by adjusting height with collar(s) 127). Note do not allow unipod 118 leg to extend below tube 155 and touching supporting surface or instability may result.

Figure 6B:
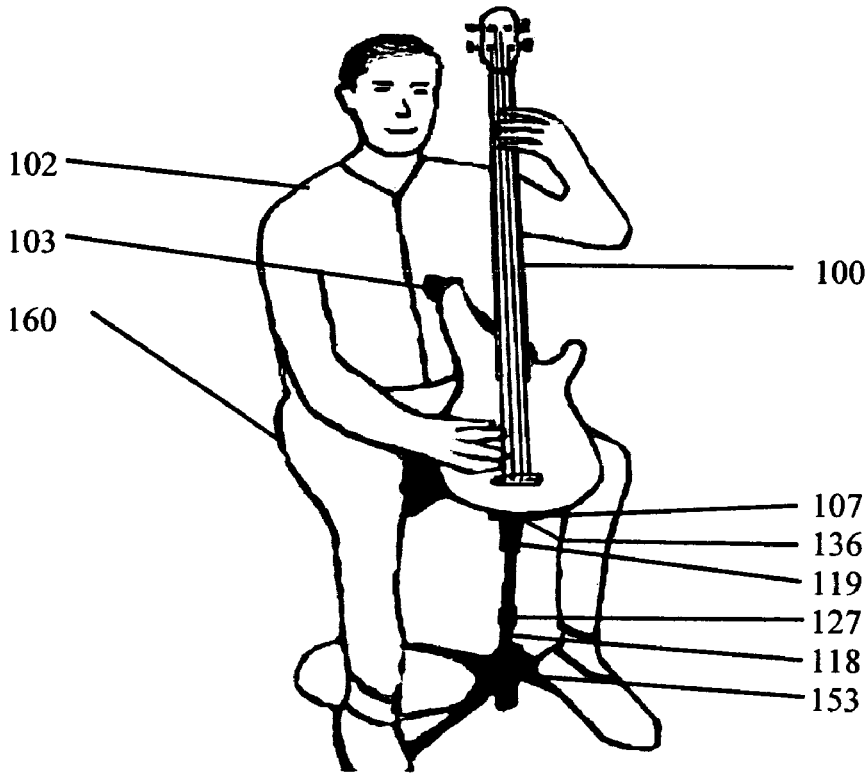

A view of guitar 100 and unipod 119 are shown in seated-playing position in FIG. 6*b*. Musician 102 is seated on a stool 160. Leg 118 is adjusted to appropriate length and secured through manipulation of collar(s) 127 by loosing and tightening. Musician 102 has arm 103 positioned against his chest for stability during supporting and playing guitar 100. Arm 107 is shown with pin 136 locating lower support from unipod 119 to guitar 100. Leg 118 is inserted into stand 153 as discussed in FIG. 6*a*. Musician 102 could also play apparatus without stand 153 for additional freedom of playing and manipulating of guitar 100 (cup 105 should be re-installed on leg 118 to avoid damage to leg 118 or supporting surface).

Figure 7:
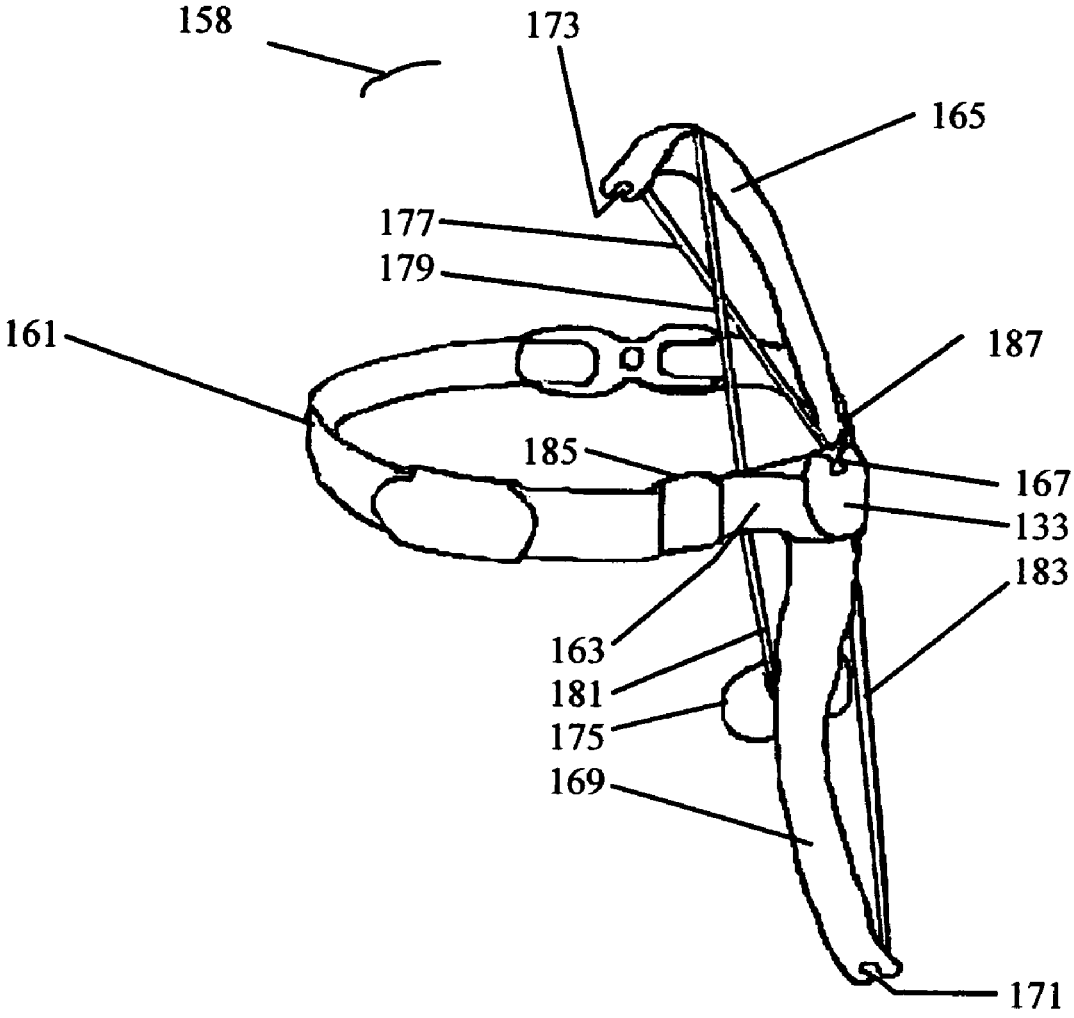
FIG. 7 is a view of a mobile bass guitar stand up adapter.

A mobile bass guitar stand up adapter 158 is shown in FIG. 7. Mobility adaptation is achieved by combining a supportive belt 161 with guitar 100 as adapted to arms 103, 107 and unipid 119 in previous drawings. A suitable supportive belt 161 is disclosed in more detail in U.S. Pat. No. 6,137,675, issued to Perkins on Oct. 14, 2000. The subject matter of which is hereby incorporated by reference in it's entirety into this disclosure. In the present embodiment belt 161 has a horizontal strap 163 bracket fashioned from plastic or similar light weight and strong material. Strap 163 is heated and shaped to facilitate a central receiving slot 167 that will accept pin 130 (FIG. 2*a*) and enough length to secure along side belt 161. Slot 167 is constructed as slot 137 in FIG. 2*b*. Returning to FIG. 7, strap 163 is secured to belt 161 with 2 clips. Shown are front clip 185 and rear clip 187. These clips are fashioned from plastic or similar material. Alternative methods of securing strap 163 would include a hook over belt 161 or a collar that would slide over belt 161 and strap 163. Strap 163 has an upper brace arm 165 that is welded (heat or chemical for plastic) close to the rear near clip 187. Arm 165 is fashioned from plastic or similar material and shaped to position against the musician's chest. Arm 165 has an upper slot (as slot 137 in FIG. 2*b*) arranged to accept pin 134 (FIG. 2*a*). Returning to FIG. 7 arm 165 has stabilizing braces for flex reduction and force distribution in a strut 177 fashioned from plastic or similar material secured by welding (heat or chemical) or gluing to strap 163 and along side slot 173 (leaving clearance for guitar body~10 mm) and a strut 179 brace fashioned from plastic or similar material is welded to strap 163 just behind clip 185 position and the top of the arc of arm 165. Additional guitar support is provided by lower arm 169. Arm 169 is fashioned from plastic or similar material and is welded or glued to strap 163 behind surface 133. Arm 169 has a lower slot 171 (as slot 137 FIG. 2*b*) for receiving pin 136 (FIG. 2*a*). Retuning to FIG. 7 a hip rest 175 is provided to stabilize the assembly and distribute loads on the belt 161 when a guitar is mounted. Additional stability is provided by a strut 181 fashioned from plastic or similar material welded to strap 163 just below strut 179 and between rest 175 and arm 169. Additional stability is provided by a strut 183 fashioned from plastic or similar material welded to strap 163 below arm 165 and just behind slot 171 (leaving clearance for guitar body~10 mm). Alternative mounting could include arm 165, strut 177, and strut 179 are inserted into receivers on strap 163 instead of welding. This mounting would make transportation of apparatus easier. Arm 169 with strut 181 and strut 183 could also be alternatively assembled by inserting into a receiver on strap 163 for easier transportation. Presently, adapter 158 is installed by placing strap 163 against belt 161 and sliding clip 185 over belt 161 and front of strap 163 to strut 179 and sliding clip 187 over belt 161 and back of strap 163 until seated next to arm 165. Assembly can be removed from belt 161 by sliding clips 185 and 187 away from adapter 158 to expose brace and release from belt 161.

Figure 8:
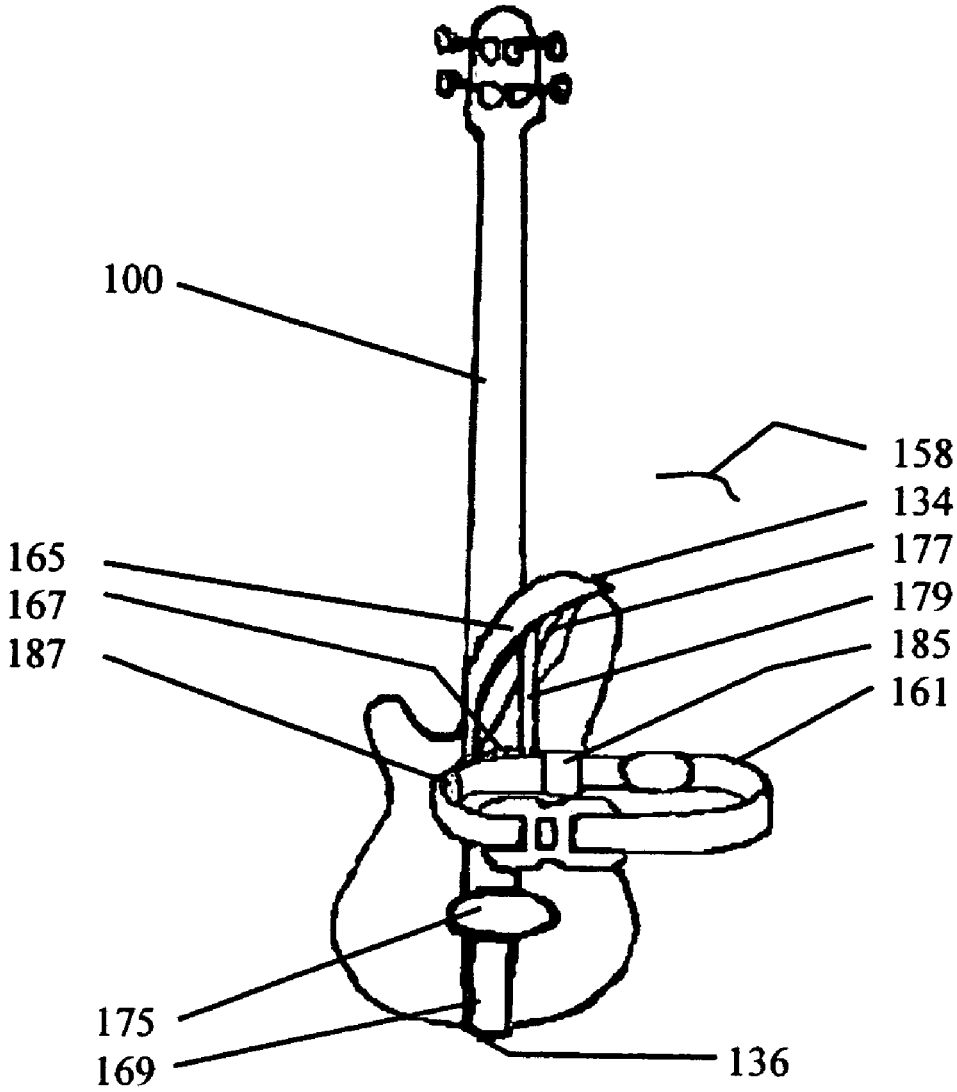
FIG. 8 is a rear view of mobile bass guitar stand up adapter.

A rear view of adapter 158 with a guitar 100 is shown in FIG. 8 for apparatus perspective. Belt 161 is shown with clip 185 and clip 187 securing adapter 158. Arm 165 has strut 177, strut 179, and is mated to pin 134. Throat of slot 167 can be seen between belt 161 and guitar 100. Arm 169 has rest 175 and is mated to pin 136.

Figure 9:
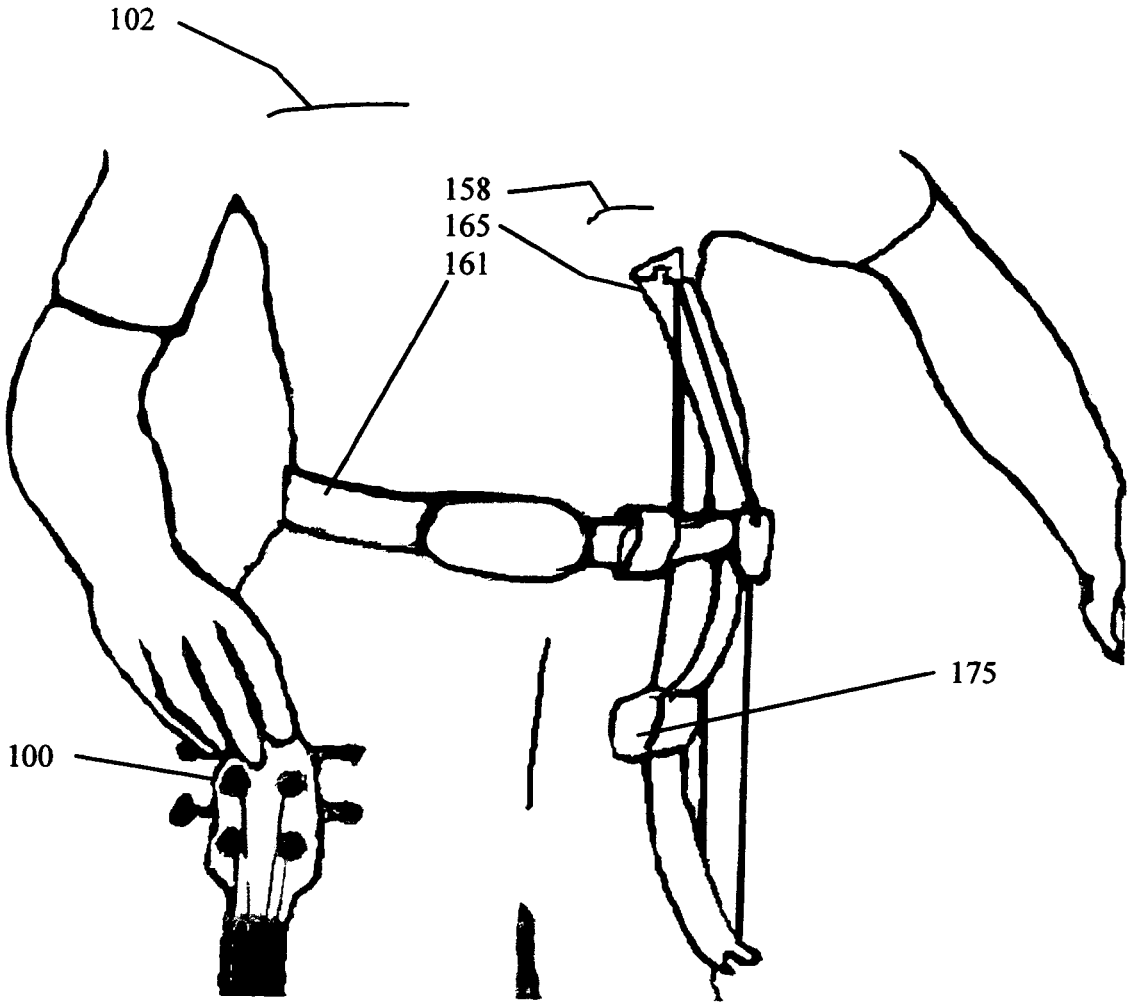
FIG. 9 is a view of mobile bass guitar stand up adapter on a musician.

A view of adapter 158 on musician 102 is shown in FIG. 9. Arm 165 is shown resting against musician 102 for proper placement. Belt 161 is shown around musician's waist. Rest 175 is shown positioned against musician 102 between hip and upper thigh. Guitar 100 is shown for perspective and is not meant to be mounted.

Figure 10:
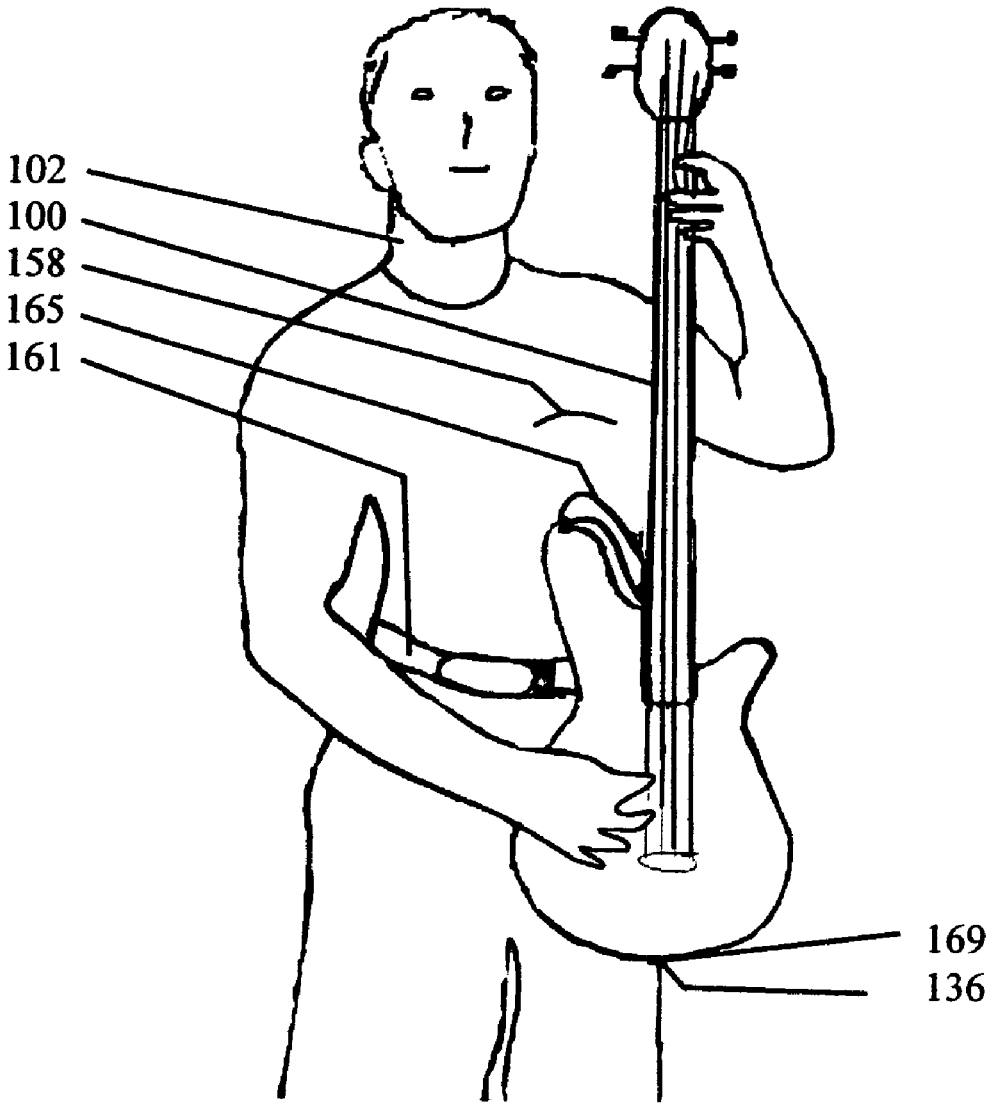
FIG. 10 is a view of mobile bass guitar stand up adapter on musician with guitar Reference Numerals in Drawings

A view of adapter 158 on musician 102 with guitar 100 is shown in FIG. 10. As in FIG. 9 arm 165 rests against musician's chest. Arm 169 secured to pin 136 provides visible mounting points. Belt 161 is shown detailing how a vertically rigid, horizontally adaptive belt can support a load such as adapter 158 and not require additional harnesses or straps. In this configuration the musician 102 can play guitar 100 with support from belt 161 and still have mobility (and dance or strut) on stage or in studio or rehearsal.

OPERATION

The assembly of my bass guitar stand up adapter begins by referring to FIG. 3*b*, adapter 107 is connected to unipod 119 with locators 141 and 143 inside and locator 145 outside loop 125 (see FIG. 4*a*).

Adapter 101 on FIG. 3*a* is secured to hole 128 on unipod 119 (on FIG. 4*a*) with bolt 115 and washer 117.

On guitar 100 the pin 130 (shown in FIG. 2*a*) is pushed into slot 137 in FIG. 2*b*. On guitar 100 pin 136 (shown in FIG. 2*a*) is pushed into slot 149 in FIG. 3*b*. On guitar 100 pin 134 (shown in FIG. 2*a*) is pushed into slot 139 in FIG. 3*a*.

The musician or player will next refer to FIG. 4*b* and grasp the unipod 119 at the barrel behind the guitar and lift the assembly. Holding the assembly by the unipod barrel with the arm 109 located about mid-chest the playing height of the system can be determined. The leg 118 length adjustment for playing height is accomplished by loosening, adjusting segment length and then tightening collar(s) 127. The playing height is subjective so musicians should try various heights as arm and finger positioning and playing is affected by height.

Center assembly in front of foot on side of arm doing fretting and take half a step back and away to obtain a starting position that will slightly lean the guitar/system against the player's chest for positioning, stability, and predictability.

When not playing guitar, unipod 119 may be inserted into stand 153 for parking (see FIG. 6*a*). Removal of cup 105 (FIG. 1) is necessary prior to insertion of leg 118 into stand 153. The stand 153 may also be used for playing. Selecting height by adjusting collar(s) 127 (FIG. 4*a*) will allow the player to perform with stand 153 either seated or standing. Lower segment of unipod 119 should never extend below tube 155 of stand 153 (FIG. 6).

Disassembly is accomplished by reversing the order of pin insertions into respective slots. Pin 134 (FIG. 4*b*) should first be removed from slot 139 (FIG. 3*a*) then pin 136 (FIG. 2*a*) from slot 149 (FIG. 3*b*), and pin 130 (FIG. 2*a*) from slot 137 (FIG. 2*b*). Arm 107 can be removed from loop 125 (FIG. 3*b*) or rotated up (if locators 141 and 143 have been bent into a loop as discussed in FIG. 3*b*) and secured against barrel of unipod 119 with a rubber band or hook and loop fasteners. Guitar 100 with minor modifications as discussed in present invention does not prohibit use of standard guitar cases for transportation. A simple tote bag or backpack can be used to transport unipod 119 (typically at shortest length) with arms 107 and 103 and stand 153. Similarly, mobile version adapter 158 with strap 163 removed from belt 161 will fit in many tote bags or backpacks.

Assembly of mobile version of the present invention is begun on FIG. 7 with pin 130 on guitar 100 being pushed into slot 167. Pin 136 is next pushed into slot 171. Pin 134 is then pushed into slot 173. Belt 161 with clip 185 and clip 187 on left side of belt 161 is secured on musician. Strap 163 is positioned on left side of belt 161 and clip 187 is slid forward along belt 161 to engage strap 163 up to base of arm 165. Clip 185 is slid back along belt 161 to engage strap 163 back to strut 179.

Musician can now enjoy the advantages of upright playing positions to include standing, sitting and with mobility.

CONCLUSIONS, RAMIFICATIONS, AND SCOPE

Accordingly, the reader will see that the bass guitar stand up adapter of this invention can be used to convert a standard electric bass guitar designed to be played with an over the shoulder strap into a stand up or double bass configuration. The converted guitar system can be easily disassembled (using instructions in Operation in reverse order) and transported as a regular bass guitar, a short unipod, and base of a tripod. This method of transportation reduces effort, strain and damage due to bulk of a classical bass. This system affords the ease and pleasure of upright playing (less wrist compound flexure and arm twisting) with a great reduction in cost. Typically a decent strap style bass can be purchased between $300 to 500 while a upright will cost $2,000 to 3,000. Additionally, my bass guitar stand up adapter system will afford greater flexibility for sitting and practicing. Further, my bass guitar stand up adapter system will facilitate docking or parking for secure resting while also affording stable playing positions (standing and seated) The musician can also choose from guitars that are fretted or fretless. This will allow musicians challenged by positioning with intonation problems expanded musical horizons. Newer 5 and 6 string basses are becoming popular and allow musicians' immediate access to newer designs for lower costs, and even the only way to get limited technologies in some cases. Additional mobility choices presented herein afford improved performance flexibility and freedom.

While specific designs and descriptions have been disclosed these should not be considered as limiting the scope of the invention but merely as providing illustrations of some of the presently preferred embodiments of this invention. For example a stool or chair could be employed by a player for practicing or performing with the adjustable height capability or any combination of strings and frets on mounted guitar can be substituted and similar benefits could be realized.

Thus the scope of the invention should be determined by the appended claims and their legal equivalents, rather than by examples given.

What is claimed is:

1. An apparatus for positioning and supporting a standard electric bass guitar in classical upright playing orientation, which comprises:

a unipod;

an adjustable length leg that mounts into the unipod;

the adjustable length leg also extends from the unipod;

a frictionally adjusting collar for securing a desired length of the adjustable length leg extending from the unipod, a first mounting receiver on the upper portion of the unipod attaching an upper main adapter to the unipod;

wherein the upper main adapter comprises;

a lower strap mount loop;

an upper arm adapter extending from the loop of the upper main adapter;

a first attachment receiver slot on the loop of the upper main adapter;

a second attachment receiver slot on the end of upper arm adapter;

wherein the first and second attachment receivers comprise:

slots;

a throat width in the slots that restricts movement of an attachment strap pin;

a concluding center diameter in each slot that equals the diameter of pin;

a lower arm adapter;

a mounting loop on the lower end of said support tube for attaching the lower arm adapter;

an attachment receiver slot on the lower arm adapter, wherein the slot comprises:

a throat width in the slot that restricts movement of an attachment strap pin;

a concluding center diameter in the slot that equals the diameter of the pin;

and;

a standard electric bass guitar comprising:

a body, neck and attachment strap pins, wherein the neck is orientated upwardly with respect to the body;

a first attachment strap pin on an upper portion of the guitar body;

a second attachment strap pin on a central, back portion of the guitar body;

a third attachment strap pin on a lower portion of the guitar body; and wherein to attach the said guitar to said apparatus, user performs, sliding strap pins on the guitar into respective receiver slots on the apparatus.

2. An apparatus according to claim 1 wherein, the adjustable length leg is extendable to a desired length.

3. An apparatus according to claim 1 wherein, the adjustable length leg is secured with the frictionally adjusting collar to the desired length.

4. An apparatus according to claim 1 wherein, the adjustable length leg secured length determines a musician's playing height.

5. An apparatus according to claim 1 wherein, adjustable length leg facilitates musician playing while seated in a chair.

6. An apparatus according to claim 1 wherein, adjustable length leg facilitates musician playing while standing.

7. An apparatus according to claim 1 wherein, adjustable length leg facilitates musician playing while seated on a stool.

8. An apparatus according to claim 1 wherein, the shape of the upper adapter upper arm determines the musician's playing orientation.

9. An apparatus according to claim 1 wherein, the upper adapter arm is adjustable to adapt to multiple musicians' orientation.

10. An apparatus according to claim 1 wherein, the length of lower adapter arm determines musician's guitar playing angle.

11. An apparatus according to claim 1 wherein, the length of lower adapter arm is adjustable to adapt to multiple musicians' playing angles.

12. An apparatus according to claim 1 wherein, bottom of the collapsible leg is inserted into a supportive base tri-pod stand.

13. An apparatus according to claim 12 wherein, the supportive base tri-pod stand provides support while musician plays guitar.

14. An apparatus according to claim 12 wherein, the supportive base tri-pod stand provides support while guitar is not played.

15. An apparatus according to claim 12 wherein, the supportive base tri-pod stand provides support to selectively secured leg to facilitate musician playing while seated in a chair.

16. An apparatus according to claim 12 wherein, the supportive base tri-pod stand provides support to selectively secured leg to facilitate musician playing while standing.

17. An apparatus according to claim 12 wherein, the supportive base tri-pod stand provides support to selectively secured leg to facilitate musician playing while seated on a stool.

18. An apparatus according to claim 1 for positioning and supporting a standard electric bass guitar in an upright position that includes upper, central, and lower strap pins and a unipod consisting of a support tube with strap mount loop, a lower arm adapter, an upper arm adapter and adjustable leg that collapses for transporting, which comprises:

a collapsed adjustable leg into the support tube;

a pivoted lower adapter arm;

a strap retains pivoted lower adapter arm;

the guitar lower strap pin removed from a slot in the lower arm adapter;

the guitar center strap pin removed from a slot in the central arm adapter;

the guitar upper strap pin removed from an a slot in the upper arm adapter; and a tote bag is employed to contain and transport the collapsed apparatus.

19. An apparatus for positioning and supporting an electric bass guitar in classical upright playing orientation that includes upper, central, and lower strap pins that is not stationary, which comprises:

a vertically rigid horizontally adaptive supporting belt;

an adapter upper brace arm with a stabilizing strut and an upper slot for the upper attachment strap pin;

a detachable horizontal member adapter secured to belt with;

a pair of horizontal sliding vertical clips an adapter central receiving slot for the central guitar strap pin;

an adapter lower arm with a stabilizing strut and a lower slot for the lower attachment strap pin;

an arrangement of adapter arm(s) to triangulate support and playing forces; and the collection of guitar mounted strap pin(s) into slot(s) arrangement on apparatus to facilitate easy assembly and disassembly of the non-stationary adapter.

20. An apparatus according to claim 19 wherein, upper, central, and lower strap pins are mated to respective support arm adapters that are secured to a horizontally, adaptable, vertically rigid supportive belt for musician playing mobility.

21. An apparatus according to claim 19 wherein, the detachable horizontal adapter forms a main adapter bracket.

22. An apparatus according to claim 19 wherein, a pair of horizontal sliding vertical clips secure horizontal member to supportive belt.

23. An apparatus according to claim 19 wherein, an upper brace arm extends from horizontal strap to a receiver slot for attachment to the upper strap pin on the upper body of the guitar.

24. An apparatus according to claim 19 wherein, a central slot is provided for attachment to guitar strap pin on the central body of the guitar.

25. An apparatus according to claim 19 wherein, a lower arm extends from horizontal strap to the central slot for attachment to lower strap pin on the lower body of the guitar.

26. An apparatus according to claim 19 wherein, the stabilizing struts stabilize guitar motion during playing.

27. A apparatus according to claim 19 wherein, the upper, central, and lower strap pins are inserted into the respective receiver slots to facilitate non-stationary playing by musician.

28. A apparatus according to claim 19 wherein, the upper, central, and lower strap pins are removed from with the respective receiver slots to facilitate transportation and storage.

* * * * *